US005226432A

United States Patent [19]

Pollentzke et al.

[11] Patent Number: 5,226,432

[45] Date of Patent: Jul. 13, 1993

[54] METHOD OF AND APPARATUS FOR DRAPING ROD-LIKE FILLERS INTO WEBS OF WRAPPING MATERIAL

[75] Inventors: Roland Pollentzke, Geesthacht; Hubertus Schulz, Hamburg, both of Fed. Rep. of Germany

[73] Assignee: Körber AG, Hamburg, Fed. Rep. of Germany

[21] Appl. No.: 869,918

[22] Filed: Apr. 16, 1992

[30] Foreign Application Priority Data

May 2, 1991 [DE] Fed. Rep. of Germany ..... 4114374

[51] Int. Cl.[5] ..... A24C 5/24

[52] U.S. Cl. ..... 131/69; 131/35; 131/343; 493/4; 493/39; 493/41

[58] Field of Search ..... 131/284, 35, 37, 69, 131/84.1, 343; 493/4, 39, 41, 128, 130, 131, 150, 276, 277, 279

[56] References Cited

U.S. PATENT DOCUMENTS

| | | | |
|---|---|---|---|
| 3,373,052 | 3/1968 | Rode | 131/69 X |
| 3,400,007 | 9/1968 | Rudszinat | 131/37 X |
| 3,769,883 | 11/1973 | Greve | 93/1 C |
| 4,010,678 | 3/1977 | Greve | 93/77 FT |
| 4,510,885 | 4/1985 | Greve | 118/674 |
| 4,575,368 | 3/1986 | Sagawa et al. | 131/69 X |
| 4,580,579 | 4/1986 | Wahle | 131/84.3 |
| 4,776,351 | 10/1988 | Wahle et al. | 131/69 |

FOREIGN PATENT DOCUMENTS

| | | | |
|---|---|---|---|
| 2180780 | 4/1987 | United Kingdom | 131/69 |

*Primary Examiner*—V. Millin
*Assistant Examiner*—J. Doyle
*Attorney, Agent, or Firm*—Peter K. Kontler

[57] ABSTRACT

A continuous rod-like filler of tobacco or filter material for tobacco smoke and a continuous web of cigarette paper or other wrapping material are advanced at a plurality of different speeds toward and into a wrapping mechanism wherein the web is draped around the filler to form therewith a continuous tobacco rod or filter rod wherein the marginal portions of the draped web overlie each other to form an elongated seam. One marginal portion of the advancing web is coated by an adjustable paster with a variable quantity of adhesive which bonds the overlying marginal portions of the draped web to each other. The quantity of applied adhesive is varied in dependency upon the speed of advancement of the web in such a way that the quantity of applied adhesive is increased when the speed of the web is reduced and that the quantity of applied adhesive is decreased in response to increasing speed of the web. Such quantity can remain constant when the speed of the web reaches a nominal value.

20 Claims, 2 Drawing Sheets

METHOD OF AND APPARATUS FOR DRAPING ROD-LIKE FILLERS INTO WEBS OF WRAPPING MATERIAL

BACKGROUND OF THE INVENTION

The invention relates to improvements in methods of and in apparatus for making continuous rods which can be subdivided into cigarettes, cigars, cigarillos, filter rod sections and analogous rod-shaped articles of the tobacco processing industry. More particularly, the invention relates to improvements in methods of and in apparatus for draping rod-like fillers of natural, reconstituted and/or substitute tobacco, filter material for tobacco smoke and/or other fibrous material of the tobacco processing industry into webs of cigarette paper, filter paper, imitation cork, tipping paper or other suitable wrapping material to form continuous rods of the tobacco processing industry. Still more particularly, the invention relates to improvements in methods of and in apparatus for enhancing the quality of customary seams which are formed by overlapping marginal portions of webs of wrapping material as a result of draping such webs around rod-like fillers of smokable material or filter material for tobacco smoke.

A continuous web of cigarette paper, filter paper or the like is provided with a film or coat of suitable adhesive on its way toward or at the wrapping station where successive increments of the web are draped around successive increments of a continuous rod of smokable material or filter material for tobacco smoke. The applied adhesive serves to bond the overlapping marginal portions of the draped web to each other in order to prevent opening of the seam during further treatment of the rod, e.g., during subdivision of the rod into rod-shaped articles of unit length or multiple unit length. In many instances, the film of adhesive is applied, by a so-called paster, to one marginal portion at one side of the web while the web advances toward or at the wrapping station. The adhesive-coated marginal portion is folded over and bonded to the other marginal portion during passage through and downstream of the wrapping mechanism. The thus obtained seam extends in parallelism with the axis of the finished rod.

The rod-like filler which is to be draped into a web of wrapping material can constitute a one-piece body of shredded or otherwise comminuted particles of smokable material or a one-piece body of fibrous filter material, such as a tow of acetate fibers which are contacted by a softening agent. Reference may be had, for example, to U.S. Pat. No. 3,769,883 granted Nov. 6, 1973 to Greve for "Apparatus for regulating the operation of filter rod making machines". However, it is equally possible to drape a rod-like filler consisting of a file of discrete rod-like sections which are or can be disposed end to end. See, for example, commonly owned U.S. Pat. No. 4,010,678 granted Mar. 8, 1977 to Greve et al. for "Method and apparatus for making composite filter plugs".

The adhesive which is used in tobacco rod making or filter rod making machines is often a hotmelt. However, it is equally known and possible to use other types of adhesive substances such as dispersion type glue, starch-containing glue and/or others.

The quantity of applied adhesive should be selected in such a way that it suffices to ensure the establishment of a reliable bond between the overlying marginal portions of the draped web before the rod is subdivided into sections of unit length or multiple unit length. On the other hand, the quantity of applied adhesive should not be excessive because the surplus is likely to issue from the seam and contaminate, and thus affect the appearance of, the external surface of the tubular wrapper of the finished rod. Accurate metering of the applied quantities of adhesive does not present many problems if the paster is located close or very close to the locus where the marginal portions of the draped web are caused to contact each other in the wrapping mechanism. However, the positioning of a satisfactory paster into close or immediate proximity to the wrapping station is not always possible, either for structural reasons, due to lack of adequate space and/or on other grounds. In such rod making machines, the paster must be installed adjacent the path of advancement of the web toward the wrapping mechanism, i.e., upstream and often well ahead of the wrapping station. This can create numerous and serious problems in connection with the application of satisfactory quantities of adhesive per unit area or unit length of the web, particularly since the speed of advancement of the web must be variable to thus ensure proper acceleration of the web during starting or restarting of the machine, proper deceleration of the web while the machine is in the process of being brought to a halt, and proper deceleration of the web in response to malfunctioning of the machine, for the purposes of inspection, for testing and/or for other reasons. Thus, if the speed of the web is reduced below or substantially below the nominal speed in a rod making machine wherein the paster is located well upstream of the wrapping station, the applied film or layer of adhesive is likely to set, at least in part, on its way from the paster to the wrapping station so that the seam of the tubular envelope forming part of the finished rod is not adequately closed and sealed and permits the inflow of atmospheric air and/or the escape of smoke when an article embodying or consisting of a portion of such defective rod is lighted.

Attempts to overcome the just enumerated problems in rod making machines wherein the paster discharges hotmelt include the provision of a heating device in the wrapping mechanism proper. Such heating device raises the temperature of and thus reactivates the hotmelt just before or while the adhesive-coated marginal portion of the web is caused to contact the other marginal portion. The provision of a heating device at the wrapping station contributes to complexity and to the cost of such mechanism and of the entire rod making machine. Moreover, reheating of hotmelt at the wrapping station renders it necessary to enhance the effectiveness of the cooling unit which is located downstream of the wrapping station and acts upon the freshly formed increments of the seam in order to promote rapid setting of hotmelt and to thus ensure reliable bonding of the overlying marginal portions of the draped web to one another.

OBJECTS OF THE INVENTION

An object of the invention is to provide a novel and improved method of draping a web of wrapping material around a rod-like filler for the purpose of producing a continuous rod which is to be subdivided into rod-shaped articles of the tobacco processing industry.

Another object of the invention is to provide a method which renders it possible to establish a reliable bond between the overlapping marginal portions of a draped web of cigarette paper, tipping paper, filter paper or other suitable wrapping material regardless of variations of the speed of advancement of the web toward and into the wrapping station where the web is draped around a continuous rod-like filler of smokable material or filter material for tobacco smoke.

A further object of the invention is to provide a method which renders it possible to reliably bond the marginal portions of the running web of wrapping material to each other irrespective of the distance of the paster from the wrapping station.

An additional object of the invention is to provide a method which renders it possible to avoid undesirable escape of adhesive from the seam and resulting contamination of the exterior of the finished rod.

Still another object of the invention is to provide a novel and improved method of making high-quality tobacco containing rods.

A further object of the invention is to provide a novel and improved method of making a high-quality cigarette, cigar or cigarillo rod.

Another object of the invention is to provide a novel and improved apparatus for the practice of the above outlined method.

An additional object of the invention is to provide an adhesive applying apparatus which can be installed in existing cigarette, cigar or cigarillo making machines or filter rod making machines as a superior substitute for existing apparatus.

Still another object of the invention is to provide a novel and improved rod making machine which embodies the above outlined adhesive applying apparatus.

A further object of the invention is to provide the adhesive applying apparatus with novel and improved means for controlling the rate of application of adhesive per unit area and/or unit length of a running web of cigarette paper, filter paper, tipping paper or other wrapping material which is used in rod making machines.

An additional object of the invention is to provide an adhesive applying apparatus which can apply optimal quantities of adhesive to one or more selected portions of a running web of wrapping material irrespective of the distance of the apparatus from the wrapping station.

SUMMARY OF THE INVENTION

One feature of the present invention resides in the provision of a method of making a continuous rod (e.g., a cigarette rod, a cigar rod, a cigarillo rod or a filter rod) from a rod-like continuous filler of fibrous material (such as cellulose acetate fibers or natural tobacco, reconstituted tobacco and/or substitute tobacco) and a continuous web of wrapping material having a first side, a second side, a first marginal portion and a second marginal portion. The improved method comprises the steps of advancing the filler and the web along predetermined paths toward a wrapping station at one of a plurality of different speeds, applying a variable quantity of an adhesive (such as hotmelt, a starch-containing paste or another glue) to the advancing web; draping the web around the filler at the wrapping station so that the marginal portions of the draped web overlap and adhere to each other to form a seam which normally extends in parallelism with the axis of the thus obtained rod, varying the speed of the web, and varying the quantity of applied adhesive in response to varying speed of the web.

The step of applying adhesive to the web is preferably carried out upstream of the wrapping station. Such applying step can include applying a variable quantity of adhesive to one marginal portion at one side of the advancing web.

The step of varying the quantity of applied adhesive can comprise reducing the quantity of applied adhesive in response to increasing speed of the web.

In accordance with a presently preferred embodiment of the method, the speeds of the web include a nominal speed and a threshold speed below the nominal speed, and the variable quantity includes a nominal quantity which is applied to the advancing web at the nominal speed. The step of varying the quantity of applied adhesive then includes increasing the quantity of applied adhesive above the nominal quantity when the speed of the web is reduced below the threshold speed. The step of increasing the quantity of applied adhesive above the nominal quantity preferably includes increasing the quantity of applied adhesive by up to approximately 60 percent above the nominal quantity.

Another feature of the invention resides in the provision of an apparatus or machine for making a continuous rod from a continuous rod-like filler of fibrous material and a continuous web of wrapping material having a first side, a second side, a first marginal portion and a second marginal portion. The improved apparatus comprises a wrapping mechanism (also called a format) having means for draping the web around the filler to form the rod wherein the marginal portions of the web overlie each other, means for advancing the web along a predetermined path into the wrapping mechanism at a plurality of different speeds, adjustable means for applying a variable quantity of an adhesive (e.g., hotmelt) to successive increments of the advancing web so that the thus applied adhesive bonds the overlying marginal portions of the draped web to each other, means for monitoring a variable parameter denoting the speed of the web (e.g., for directly monitoring the speed of the advancing web and/or for monitoring the speed of the prime mover of the means for advancing the web), and means for adjusting the adhesive applying means in response to variations of the variable parameter. Such adjusting means is or can be operatively connected with the monitoring means.

The adhesive applying means can include means for applying adhesive to at least one marginal portion at one side of the advancing web, and the draping means of the wrapping mechanism comprises means for converting the overlapping marginal portions of the draped web into a seam extending longitudinally of the rod.

The adjusting means can include means for effecting a reduction of the quantity of applied adhesive in response to increasing speed, and for effecting an increase of the quantity of applied adhesive in response to decreasing speed, of the advancing web.

The different speeds include a threshold speed and the adjusting means can include means for effecting the application of a nominal quantity of adhesive when the speed of the advancing web exceeds the threshold speed and for effecting the application of a greater second quantity of adhesive when the speed of the advancing web is less than the threshold speed. Such apparatus can further comprise means (e.g., a memory) for transmitting to the adjusting means signals which denote the threshold speed.

Alternatively, the adjusting means can include means for effecting a continuous reduction of the quantity of applied adhesive below a predetermined nominal quantity in response to increasing speed of the advancing web toward the threshold speed, and for effecting a continuous increase of the quantity of applied adhesive in response to decreasing speed of the advancing web below the threshold speed. Again, this apparatus can comprise means (such as the aforementioned memory) for transmitting to the adjusting means signals denoting the threshold speed.

The adhesive applying means can comprise at least one nozzle which serves to discharge adhesive at a variable rate against the advancing web.

The apparatus further comprises means for conveying the continuous rod-like filler toward and in the wrapping station at the aforementioned plurality of different speeds. Such conveying means can include means for converting a continuous tow of fibrous filter material for tobacco smoke into the rod-like filler if the ultimate product is a rod of filter material. Alternatively, and if the ultimate product is a continuous cigarette, cigar or cigarillo rod, the conveying means can comprise means for converting particles of smokable material into the aforementioned continuous rod-like filler.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
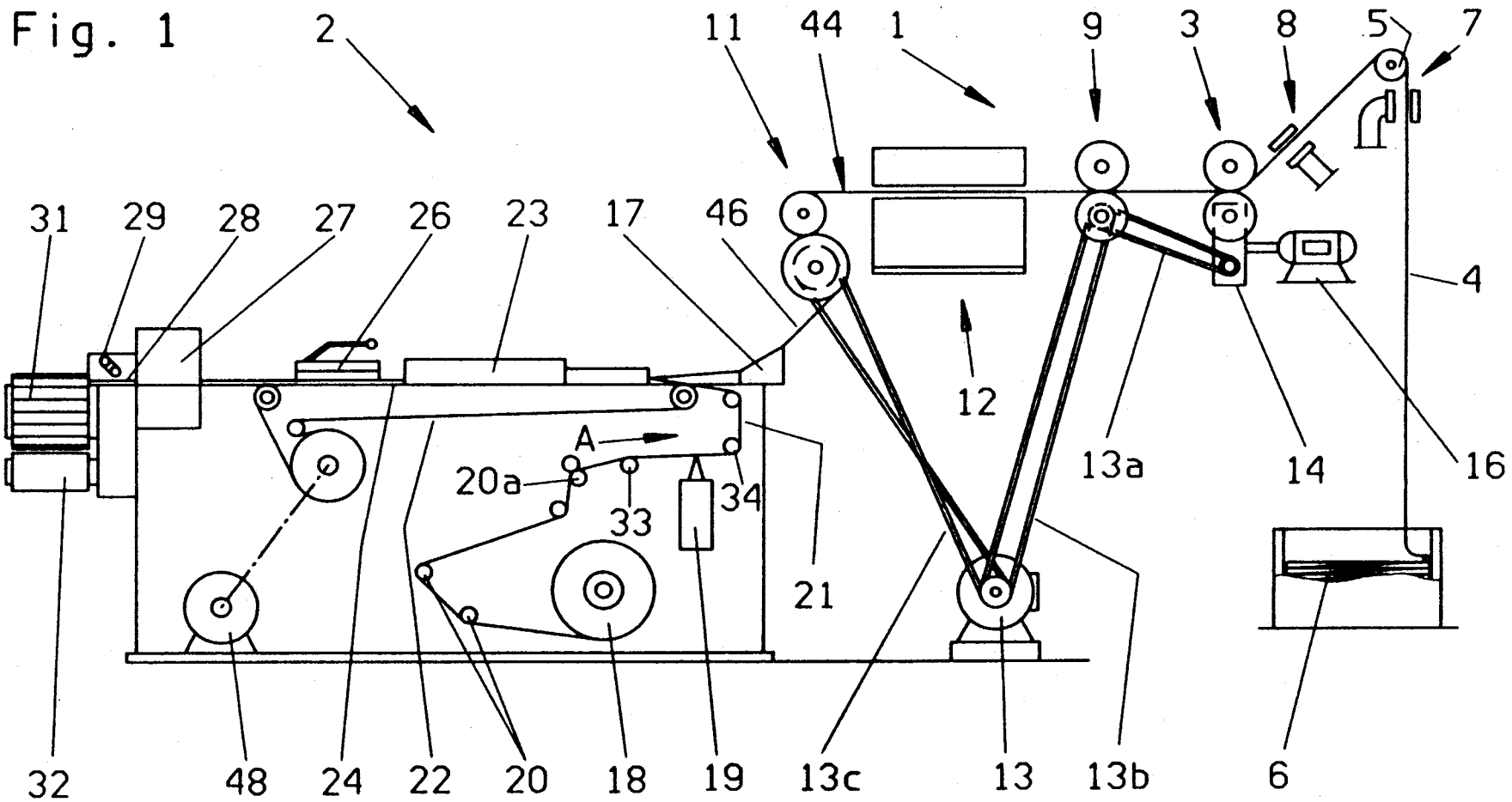
FIG. 1 is a schematic side elevational view of a filter rod making machine employing an adhesive applying apparatus which embodies one form of the invention.
Figure 2:
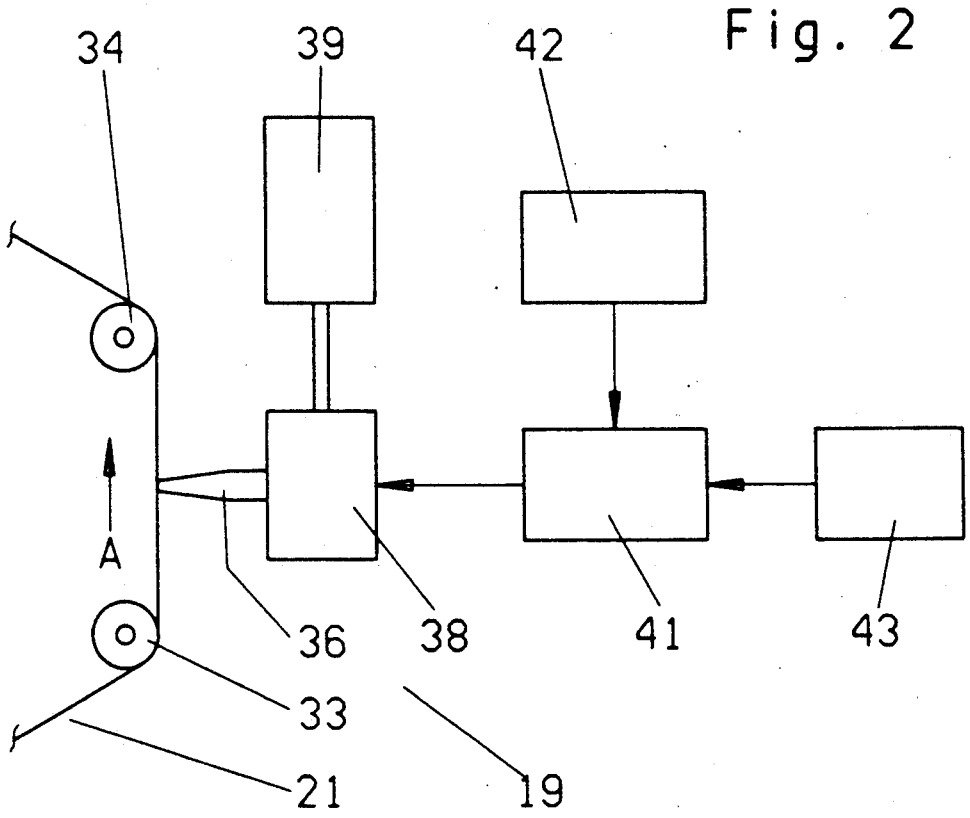
FIG. 2 is a block diagram showing certain components of the adhesive applying apparatus in the machine of FIG. 1.

Referring first to FIG. 1, there is shown a filter rod making machine wherein a continuous web 21 of filter paper is draped around a continuous rod-like filler 46 of fibrous filter material to form a continuous filter rod 24. The machine which is shown in FIG. 2 comprises two main units, namely a first unit 1 which serves to form and convey the rod-like filler 46 toward and into a wrapping mechanism 23, and a second unit 2 which includes the wrapping mechanism 23 and wherein the rod-like filler 46 is draped into the web 21 and the resulting continuous filter rod 24 is subdivided into filter rod sections 28 of unit length or multiple unit length. The sections 28 can be converted into the mouthpieces of filter cigarettes, cigars or cigarillos in a standard filter tipping machine, e.g., a machine known as MAX which is made and distributed by the assignee of the present application.

The first unit 1 of the illustrated filter rod making machine comprises a pair of driven advancing rolls 3 which draw a continuous tow 4 of fibrous filter material (e.g., acetate fibers) from a bale 6 or another suitable source. On their way toward the nip of the advancing rolls 3, successive increments of the tow 4 are trained over a pulley 5 and they advance past two so-called banding devices 7 and 8 having nozzles for jets of compressed air or other suitable means for spreading out and loosening the filaments of the tow 4 so that the latter forms a flat strip during transport through the nip of the advancing rolls 3, thereupon through the nip of a second pair of driven advancing rolls 9, through an applicator 12 of a suitable softening agent (such as triacetin), through the nip of a third pair of driven advancing rolls 11 and into a so-called gathering horn 17 of the second unit 2.

The advancing rolls 3 and 9 constitute a stretching device which eliminates the crimps of filaments of the tow, either entirely or in part, so that the filaments of the flat strip of filter material entering the nip of the rolls 9 are, or can be, at least substantially parallel to each other. This facilitates predictable distribution of softening agent which is sprayed by the applicator 12, e.g., in a manner as disclosed in full detail in commonly owned U.S. Pat. No. 4,510,885 granted Apr. 16, 1985 to Greve et al. for "Apparatus for applying atomized liquid plasticizer to a running tow of filamentary filter material". The disclosure of this patent, and of each other patent mentioned in the present application, is incorporated herein by reference. If the diameters of the rolls 3 and 9 are the same, the RPM of the rolls 3 is less than the RPM of the rolls 9 so that the filaments of the tow 4 are necessarily stretched on their way from the nip of the rolls 3 toward and into the nip of the rolls 9. The extent of stretching of the tow 4 can be regulated within a desired range. To this end, the lower advancing roll 3 is driven by the output element of a transmission 14 whose ratio is variable by a suitable servomotor 16. A main prime mover 13 is provided to drive the advancing rolls 9 by way of a belt or chain transmission **13*b*, the input element of the transmission 14 by way of a belt or chain transmission 13*a*, and the rolls 11 by way of a belt or chain transmission 13*c*. The main prime mover 13 can constitute a variable-speed electric motor. It is equally possible to employ two or more discrete prime movers, e.g., a discrete prime mover for each of the three pairs of advancing rolls 3, 9 and 11**. Each discrete prime mover preferably comprises a separately regulatable variable-speed electric motor or another suitable variable-speed motor.

The selected ratio of the RPM of the rolls 3 to the RPM of the rolls 9 determines the extent of stretching of filaments of the tow 4 on their way toward the applicator 12. The rolls 3 perform the function of a brake acting upon the filaments which are being entrained by the rolls 11. The drive means **13*a*, 14, 16 for the rolls 3 can be omitted if these rolls are provided with fixed or adjustable brakes (not shown) which enable them to frictionally engage the filaments of the tow 4 and to thus cooperate with the driven rolls 9** in stretching the filaments to a desired extent.

The flattened tow which has been conveyed through and beyond the applicator 12 forms a relatively wide strip or band 44 which is entrained by the rolls 11 and is converted into the rod-like filler 46 on its way into and particularly in the gathering horn 17. The latter transforms the band 44 into a continuous rod which is ready to be draped into the web 21.

The web 21 is drawn off a bobbin or reel 18 and is advanced along an elongated path which is defined by a set of pulleys 20. The web advancing means can comprise at least one pair of advancing rolls 20*a*, and such advancing means further comprises a variable-speed endless belt 22, called garniture and forming part of the wrapping mechanism 23. The belt 22 also entrains the rod-like filler 46 and drapes successive increments of the web 21 around successive increments of the filler to thus convert the web into a tubular envelope which confines the filler and forms therewith the aforementioned continuous filter rod 24.

Figure 3:
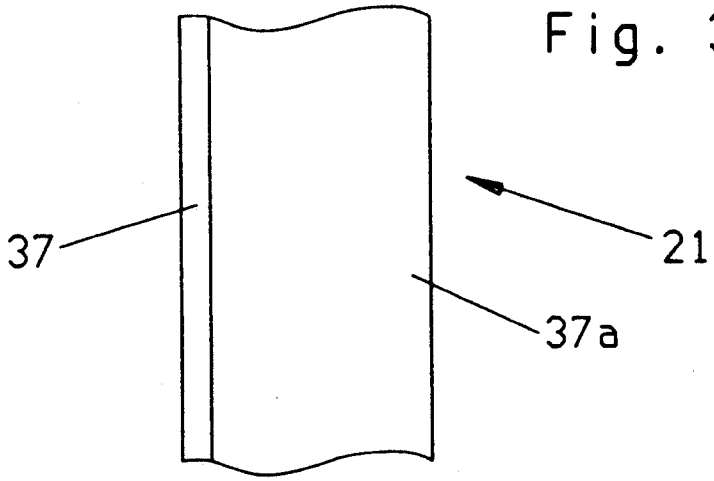
FIG. 3 is an enlarged view of a portion of a web or wrapping material, showing a film of adhesive which is applied to one marginal portion at one side of the web.

On its way along the elongated path extending from the bobbin 18 to the wrapping station accommodating the mechanism 23, the web 21 is coated with a variable quantity of suitable adhesive by an adjustable adhesive applying apparatus 19 (hereinafter called paster for short). The details of a presently preferred paster 19 are shown in FIG. 2, and this paster has at least one nozzle 36 which serves to apply a variable quantity of adhesive to one marginal portion 37 (FIG. 3) of the advancing web 21. The conveyor 22 drapes the web 21 around the filler 46 in such a way that the marginal portions 37 and 37*a* overlap or overlie and adhere to each other to jointly form an elongated seam which extends in substantial or exact parallelism with the axis of the filter rod 24. The adhesive film in the seam is heated or cooled by a so-called sealer 26 which is located downstream of the wrapping station. The sealer cools the seam if the applied adhesive is a hotmelt, and the sealer heats the seam if the applied adhesive is a wet adhesive which sets in response to heating.

The sealer 26 is followed by a so-called cutoff 27 which severs the advancing filter rod 24 at regular intervals to convert the rod into a file of discrete filter rod sections 28 of unit length or multiple unit length. Successive sections 28 are propelled by a rotary accelerating cam 29 to enter successive axially parallel peripheral flutes of a rotary drum-shaped conveyor 31. The latter advances the filter rod sections 28 sideways (i.e., at right angles to their respective axes) and deposits them on the upper reach of an endless belt or chain conveyor 32 which transports the filter rod sections into storage (e.g., into a reservoir of the type known as RESY which is made and distributed by the assignee of the present application) or into the magazine of a tipping machine for cigarettes, cigars or cigarillos.

Referring to FIG. 2, the web 21 is advanced in the direction of arrow A over pulleys 33, 34 which form part of the aforementioned set of pulleys 20. The nozzle 36 of the paster 19 applies to the marginal portion 37 of the advancing web a film of adhesive which is used to seal the aforediscussed seam on the tubular envelope of the finished filter rod 24. The thickness of the applied adhesive film (i.e., the quantity of adhesive which is applied per unit area or unit length of the web 21) is varied in accordance with a feature of the present invention.

The means for supplying variable quantities of adhesive to the nozzle 36 comprises a variable-delivery pump 38 which draws adhesive from a tank 39 or another source of supply and whose output is regulated by an adjusting unit or control unit 41. The paster 19 further comprises a monitoring device 42 which serves to monitor a variable parameter denoting the speed of the web 21 and transmits corresponding signals to one input of the adjusting unit 41 so that the output of the pump 38 can be regulated as a function of variations of the speed of the web 21. Another input of the adjusting unit 41 receives signals denoting a particular speed (threshold speed) of the web 21 from a suitable memory 43.

The means for driving the belt conveyor 22 and the advancing rolls 20*a* at a plurality of different speeds includes a variable speed electric motor 48 or another suitable variable speed prime mover. The device 42 can monitor the speed of the motor 48. Such speed constitutes a variable parameter which is indicative of the speed of the web 21.

In normal operation, i.e., when the filter rod making machine is operated at or close to a nominal speed, the monitoring device 42 transmits signals which cause the adjusting unit 41 to operate the pump 38 in such a way that the nozzle 36 applies a nominal quantity of adhesive per unit area or per unit length of the advancing web 21. During such operation of the filter rod machine, the speed of the pump motor is at least substantially synchronized with the speed of the web 21 and the speed of the rod-like filler 46. Thus, the quantity of applied adhesive is proportional or nearly proportional to the speed of the advancing web 21. The applied (nominal) quantity of adhesive is constant or at least nearly constant and is selected in such a way that the applied adhesive suffices to ensure reliable and predictable bonding of the marginal portions 37, 37*a* of the draped web 21 to each other, i.e., to ensure the making of a seam which can stand the developing stresses during severing by the knife or knives of the cutoff 27 and during propulsion of the filter rod sections 28 by the accelerating cam 29. The exact mode of regulating the speed of a pump motor in response to signals of varying intensity, duration and/or other characteristics (such as the signals which are transmitted by the monitoring device 42 to the adjusting unit 41 of FIG. 2) is well known to those having the required skill in the art and need not be described here.

When the speed of the advancing web 21 decreases below the threshold speed which is denoted by signals transmitted from the memory 43 to the adjusting unit 41, the unit 41 is caused to increase the output of the pump 38 so that the quantity of applied adhesive per unit area or per unit length of the web 21 is increased. Thus, and if the width of the adhesive film which is applied to the marginal portion 37 of the web 21 remains unchanged, the paster 19 then increases the thickness of the applied adhesive film. An advantage of the just described mode of operation of the paster 19 is that the quantity of bondable (activated) adhesive which reaches the wrapping station (mechanism 23) suffices to ensure the making of a reliable seam even if the interval of time which elapses to advance successive increments of the adhesive film from the nozzle 36 to the wrapping station is lengthened as a result of deceleration of the web 21. In other words, the extent to which the thickness of the adhesive film increases is selected in a manner to account for partial drying or setting of adhesive on its way from the nozzle 36 to the wrapping station. The web 21 will be advanced at a relatively low speed during acceleration following starting of the rod making machine, during deceleration preceding stoppage of the rod making machine and/or during automatic or manually induced deceleration which is required or caused by malfunctioning of the rod making machine, during testing or during inspection.

The adjusting unit 41 can regulate the operation of the pump 38 in such a way that, when the actual speed of the web 21 is less than the threshold speed, the quantity of adhesive which is applied per unit length of the web 21 is constant but higher than the quantity that is applied above the threshold speed, and that the quantity of adhesive which is applied per unit length of the web 21 is less but is also constant when the monitored speed of the web 21 varies but is above the threshold speed, particularly when the machine is operated at nominal speed. In other words, the pump 38 delivers to the nozzle 36 adhesive at a reduced constant rate when the actual speed of the web exceeds the threshold speed, and at an increased constant rate when the monitored speed of the web is less than the threshold speed. Otherwise stated, the quantity of applied adhesive is switched to the constant lower quantity when the speed of the advancing web 21 rises above the threshold speed (as denoted by signals from the memory 43 to the adjusting unit 42) or to the constant higher quantity when the speed of the advancing web 21 drops below the threshold speed. At least in most instances, the speed of the pump motor will remain synchronized with the speed of the rod making machine subsequent to the aforementioned switching step in either direction.

It is equally within the purview of the invention to construct the adjusting unit 41 in such a way that the (increased) quantity of applied adhesive does not remain constant when the speed of the advancing web 21 drops below the threshold speed but rather varies in accordance with a preselected pattern. The arrangement is preferably such that the quantity of applied adhesive increases at a selected rate as the speed of the web 21 continues to decrease below the threshold speed, and that the quantity of applied adhesive decreases (at the same or at a different selected rate) when the speed of the web 21 rises toward the threshold speed. The increase or decrease of the quantity of applied adhesive can be continuous or stepwise. Thus, the quantity of applied adhesive per unit area or per unit length of the web 21 is at a maximum value when the speed of the web 21 reaches a lowest value, and such quantity decreases (gradually or stepwise) as the speed of the web increases from the lowest speed toward the threshold speed. Analogously, the quantity of applied adhesive increases (stepwise or continuously) as the speed of the web decreases from the threshold speed toward the lowest speed. In other words, the thickness of the applied adhesive film (if the width of the film is constant) increases in response to decreasing speed but decreases in response to rising speed of the web 21. Such mode of operating the pump 38 exhibits the advantage that the quantity of applied adhesive even more accurately conforms to the prevailing operating conditions, primarily to the speed of the advancing web 21, the nature of the selected adhesive and the extent to which the adhesive sets on its way from the nozzle 36 to the wrapping station. The information which is required to ensure optimal application of adhesive will be selected empirically, and the unit 41 is then constructed or adjusted accordingly. The optimal quantity of adhesive will depend on a number of factors, such as the distance of the nozzle 36 from the wrapping station, the nature of the selected adhesive and the nature of the material of the web 21.

The improved method can be practiced, and the improved paster can be used, with particular advantage in connection with the application of hotmelt to filter paper in a filter rod making machine, such as the machine of FIG. 1. The feature that the quantity of applied adhesive is increased when the speed of the web 21 is reduced renders it possible to select the quantity of hotmelt at lower speeds of the web 21 in such a way that the hotmelt reaching the wrapping station need not be reactivated for the purpose of ensuring reliable bonding of the marginal portions 37 and 37*a* to each other. Moreover, the quantity of applied hotmelt can be readily selected in such a way that the wrapping mechanism 23 cannot expel (squeeze out) any surplus of adhesive from the freshly formed seam, i.e., the adhesive cannot contaminate the external surface of the tubular envelope of the rod 24 and/or the component parts of the wrapping mechanism 23 including the belt conveyor 22. This holds true when the adhesive is a hotmelt or any other suitable adhesive.

As already explained above, the presently preferred mode of operation of the paster 19 is such that the nozzle 36 supplies a relatively large quantity of adhesive when the filter rod making machine (and hence the web 21) is set in motion, i.e., while the speed of the web is still below the threshold speed. The paster 19 then switches to the application of a predetermined nominal quantity per unit length or per unit area of the web 21 when the latter begins to advance at the threshold speed. Such reduced quantity suffices to ensure adequate bonding of the marginal portions 37, 37*a* to each other when the web 21 is advanced at an elevated speed, and the larger quantity during advancement of the web at less than threshold speed suffices to ensure adequate bonding of the marginal portions 37, 37*a* to each other even though each increment of the applied adhesive film requires a longer interval of time to advance from the nozzle 36 to the wrapping station. This renders it possible to dispense with reheating of a hotmelt at the wrapping station regardless of the speed at which the web 21 is being advanced past and beyond the nozzle 36.

As already mentioned above, the optimal quantities of applied adhesive for different speeds of the web 21 will be determined empirically and the paster 19 is adjusted or set up accordingly. It has been found that the quantity of applied adhesive can be increased by up to 60 percent of the nominal quantity when the speed of the web 21 is reduced from the threshold speed to the lowest speed. In fact, the quantity of applied adhesive can be increased even by more than 60 percent or it can be increased by less than 60 percent above the nominal value when the speed of the web decreases to the minimum value. The extent to which the quantity of adhesive will be increased in response to decreasing speed of the web 21 will depend primarily on the characteristics of the adhesive and on the type of material of which the web 21 is made. In lieu of a hotmelt, the paster 19 can operate also with a wet adhesive, a starch containing adhesive, dispersion type adhesive and/or certain other types of adhesive.

In the machine of FIG. 1, the means for conveying the rod-like filler 46 to the wrapping station accommodating the mechanism 23 includes the first unit 1, i.e., an arrangement which serves to convert a continuous tow 4 of fibrous filter material for tobacco smoke into the rod-like filler. However, it is equally within the purview of the invention to employ the improved paster in a machine wherein particles of tobacco and/or other smokable material are converted into a rod-like tobacco filler, i.e., wherein the means for conveying the filler to the wrapping station serves to convert particles of smokable material into a rod-like filler which is ready to be draped into cigarette paper or the like. Reference may be had, for example, to commonly owned U.S. Pat. No. 4,580,579 granted Apr. 8, 1986 to Wahle et al. for "Method and apparatus for producing a composite tobacco filler". The paster which is used (at 43) in the apparatus of this patent can be replaced with the paster of FIG. 2 or with an analogous paster. In fact, the improved paster can be used in all cigarette rod making and like machines which are known as PROTOS and are made and sold by the assignee of the present application. The tobacco rod can be severed to yield plain cigarettes, cigars, cigarillos or cheroots.

An important advantage of the improved method and apparatus is that the quantity of applied adhesive can be regulated to invariably match or approximate an optimum quantity with a minimal outlay for equipment and without appreciably increasing the space requirements of the paster.

Another important advantage of the improved method and apparatus is that the paster can be installed at any desired practical distance from the wrapping station without affecting the quality of the seam between the overlapping marginal portions of the draped web.

A further important advantage of the improved method and apparatus is that variations of speed of the advancing web can no longer affect the quality of the seam.

An additional important advantage of the improved method and apparatus that a hotmelt need not be reactivated at the wrapping station even if the paster is installed at a considerable distance from such station. This, in turn, brings about the additional advantage that the wrapping mechanism is subjected to less pronounced thermally induced stresses because it is no longer necessary to extensively heat and immediately thereafter pronouncedly cool one and the same part of the wrapping mechanism 23 or two closely adjacent parts of such mechanism.

Still another important advantage of the improved method and apparatus is that the number of rejects which are turned out by the rod making machine is much smaller than the number of rejects which are turned out in machines employing conventional adhesive applying apparatus. The reason is that the quality of the tobacco rod or filter rod is satisfactory irrespective of the momentary speed of the advancing web of wrapping material; this eliminates the likelihood of production of rejects during acceleration or deceleration of the web.

Another important advantage of the improved method and apparatus is that the finished tobacco rod or filter rod is much less likely to be contaminated by surplus adhesive (which escapes from the seam in the course of the wrapping operation) than in accordance with heretofore known methods and in machines employing heretofore known adhesive applying apparatus. A conventional paster is particularly likely to cause contamination of the finished rod by surplus adhesive if the web consists of a porous wrapping material, such as various types of porous paper which are used for the making of filter rods.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of making a continuous rod from a continuous rod-like filler of fibrous material and a continuous web of wrapping material having a first side, a second side, a first marginal portion and a second marginal portion, comprising the steps of advancing the filler and the web along predetermined paths toward a wrapping station at one of a plurality of different speeds; applying a variable quantity of an adhesive to the advancing web; draping the web around the filler at the wrapping station so that the marginal portions of the draped web overlap and adhere to each other to form a seam; varying the speed of the web; and varying the quantity of applied adhesive in response to varying speed of the web.

2. The method of claim 1, wherein said applying step is carried out upstream of the wrapping station.

3. The method of claim 1, wherein said applying step includes applying a variable quantity of adhesive to one marginal portion at one side of the advancing web.

4. The method of claim 1, wherein said step of varying the quantity of applied adhesive comprises reducing the quantity of applied adhesive in response to increasing speed of the web.

5. The method of claim 1, wherein said speeds of the web include a nominal speed and a threshold speed below said nominal speed, said variable quantity including a nominal quantity which is applied to the advancing web at said nominal speed, said step of varying the quantity of applied adhesive including increasing the quantity of applied adhesive above said nominal quantity when the speed of the web is reduced below said threshold speed.

6. The method of claim 5, wherein said step of increasing the quantity of applied adhesive above said nominal quantity includes increasing the quantity of applied adhesive by up to approximately 60 percent above said nominal quantity.

7. The method of claim 1, wherein the adhesive is a hotmelt.

8. The method of claim 1, wherein the fibrous material is a filter material for tobacco smoke.

9. The method of claim 1, wherein the fibrous material is selected from the group consisting of natural tobacco, reconstituted tobacco and substitute tobacco.

10. Apparatus for making a continuous rod from a continuous rod-like filler of fibrous material and a continuous web of wrapping material having a first side, a second side, a first marginal portion and a second marginal portion, comprising a wrapping mechanism having means for draping the web around the filler to form the rod wherein the marginal portions of the web overlie each other; means for advancing the web along a predetermined path into said wrapping mechanism at a plurality of different speeds; adjustable means for applying a variable quantity of an adhesive to successive increments of the advancing web so that the thus applied adhesive bonds the overlying marginal portions of the draped web to each other; means for monitoring a variable parameter denoting the speed of the web; and means for adjusting said adhesive applying means to vary said quantity of applied adhesive in response to variations of said parameter.

11. The apparatus of claim 10, wherein said adhesive applying means includes means for applying adhesive to at least one marginal portion at one side of the advancing web and said draping means includes means for converting the overlying marginal portions of the web into a seam extending longitudinally of the rod.

12. The apparatus of claim 10, wherein said adjusting means includes means for effecting a reduction of the quantity of applied adhesive in response to increasing speed and for effecting an increase of the quantity of applied adhesive in response to decreasing speed of the web.

13. The apparatus of claim 10, wherein said different speeds include a threshold speed and said adjusting means includes means for effecting the application of a nominal quantity of adhesive when the speed of the advancing web exceeds said threshold speed and for effecting the application of a greater second quantity of adhesive when the speed of the advancing web is less than said threshold speed.

14. The apparatus of claim 13, further comprising means for transmitting to said adjusting means signals denoting said threshold speed.

15. The apparatus of claim 10, wherein said different speeds include a threshold speed and said adjusting means includes means for effecting a continuous increase of the quantity of applied adhesive above a predetermined nominal quantity in response to a reduction of the speed of the advancing web below said threshold speed and for effecting a continuous reduction of the quantity of applied adhesive in response to increasing speed of the advancing web toward said threshold speed.

16. The apparatus of claim 15, further comprising means for transmitting to said adjusting means signals denoting said threshold speed.

17. The apparatus of claim 10, wherein said adhesive applying means comprises at least one nozzle arranged to discharge adhesive against the advancing web at a variable rate.

18. The apparatus of claim 10, further comprising means for conveying the filler to said wrapping mechanism at said plurality of different speeds.

19. The apparatus of claim 18, wherein said fibrous material contains filter material for tobacco smoke and said conveying means includes means for converting a continuous tow of fibrous material into said continuous rod-like filler.

20. The apparatus of claim 18, wherein said fibrous material contains a smokable material and said conveying means comprises means for converting particles of smokable material into said continuous rod-like filler.

* * * * *